United States Patent [19]

Thatcher et al.

[11] 4,317,440

[45] Mar. 2, 1982

[54] SINGLE POINT DISPERSION SYSTEM HAVING A LOW PROFILE CARBURETOR

[75] Inventors: Arthur K. Thatcher, P. O. Box 352, Merritt Island, Fla. 32952; Ed R. McCarter, Maitland, Fla.

[73] Assignee: Arthur K. Thatcher, Merritt Island, Fla.

[21] Appl. No.: 118,451

[22] Filed: Feb. 4, 1980

Related U.S. Application Data

[60] Division of Ser. No. 868,825, Jan. 12, 1978, Pat. No. 4,231,333, which is a continuation-in-part of Ser. No. 593,001, Jul. 3, 1975, Pat. No. 4,100,896, which is a division of Ser. No. 293,377, Sep. 29, 1972, Pat. No. 3,893,434.

[51] Int. Cl.[3] ..... F02M 29/00

[52] U.S. Cl. ..... 123/590; 123/52 M; 123/470

[58] Field of Search ..... 123/590, 470, 52 M

[56] References Cited

U.S. PATENT DOCUMENTS

| | | | |
|---|---|---|---|
| 2,453,595 | 11/1948 | Rosenthal | 123/90 |
| 2,454,900 | 11/1948 | Vang | 123/590 X |
| 2,791,994 | 5/1957 | Grieb | 123/590 |
| 3,393,984 | 7/1968 | Wisman | 123/590 |
| 3,893,434 | 7/1975 | Thatcher et al. | 123/590 |
| 3,973,543 | 8/1976 | Nakada | 123/590 |
| 3,977,383 | 8/1976 | Nagumo | 123/590 |
| 4,105,004 | 8/1978 | Asai | 123/590 |
| 4,167,158 | 9/1979 | Martin | 123/590 |
| 4,176,634 | 12/1979 | Martin | 123/590 |
| 4,177,780 | 12/1979 | Pellerin | 123/590 |

*Primary Examiner*—Wendell E. Burns

*Attorney, Agent, or Firm*—Sixbey, Friedman & Leedom

[57] ABSTRACT

This invention relates to a computer controlled fuel system for an internal combustion engine including a low profile carburetor for permitting engine operation on very lean fuel/air ratios without sacrificing engine performance during critical engine operations such as start up, warm-up and acceleration. The low profile carburetor provides a single point source fuel dispersion and includes one or more throttle controlled, sliding plates for increasing fuel entrainment at low engine speeds by increasing the velocity of the airstream flow through the carburetor just before the dispersion point and by maximizing the lateral distance between the point of fuel dispersion and the carburetor airstream. The computer controlled system includes various threshold circuits for providing additional fuel and/or water injection into the carburetor airstream upon detection of predetermined engine conditions.

17 Claims, 18 Drawing Figures

SINGLE POINT DISPERSION SYSTEM HAVING A LOW PROFILE CARBURETOR

REFERENCE TO RELATED APPLICATION

This is a division of application Ser. No. 868,825, filed Jan. 12, 1978, U.S. Pat. No. 4,231,333 which is a continuation-in-part of application Ser. No. 593,001, filed July 3, 1975, now U.S. Pat. No. 4,100,896, which is a division of application Ser. No. 293,377, filed Sept. 29, 1972, now U.S. Pat. No. 3,893,434.

BACKGROUND OF THE INVENTION (1) Field of the Invention

This invention relates to the field of carburetor systems for internal combustion engines designed to operate with constant fuel to air ratios under a given set of conditions.

(2) Discussion of the Prior Art

Although significant progress in pollution abatement and improved efficiency of the internal combustion engine has been achieved by the use of recently developed dispersion enhanced, computer controlled carburetor systems, a decrease in engine performance under certain operating conditions such as start-up and acceleration has sometimes resulted. More particularly, the carburetor system disclosed in application Ser. No. 293,377 filed Sept. 29, 1972, entitled COMPUTER CNTROLLED SONIC FUEL SYSTEM, now U.S. Pat. No. 3,893,434, is capable of significantly improved pollution abatement and fuel economy over conventional carburetor systems by permitting the use of extremely lean fuel/air ratios. However, the use of such lean fuel/air ratios creates poor starting characteristics especially when the engine is cold since fuel at low temperature is not as easily vaporized and the air is more dense at a given pressure requiring the ratio of fuel to volume of air to be increased. Yet another problem which tends to impede the success of pollution abatement by modification of conventional carburetors is poor entrainment of fuel particles at engine start-up or idle. Poor entrainment and poor distribution occur at low speed because the particles of fuel are normally at least eight times heavier than air and tend to collect on the walls of the carburetor and intake manifold when the airstream is passing therethrough at a low velocity. This problem is compounded during start-up because the fuel which collects on the carburetor and intake manifold walls does not vaporize as is the case when the engine heat has had time to raise the temperature of these wall surfaces.

Even after warm-up the use of very lean fuel/air ratios may result in poor acceleration characteristics and the development of oxides of nitrogen when sufficient additional fuel is provided to obtain the desired acceleration characteristics.

OBJECTS OF THE INVENTION

It is the purpose of this invention to overcome the deficiencies noted above relating to the operation and use of lean fuel/air carburetor systems.

More particularly, it is an object of the invention to permit the operation of an internal combustion engine on very lean fuel/air ratio mixtures by providing a low profile carburetor adapted to increase fuel dispersion distribution and entrainment during low speed engine operation and to enrich the fuel/air ratio in response to pre-selected engine operating conditions.

More particularly, it is an object of this invention to increase fuel entrainment and good distribution at low engine speed by increasing the velocity of the airstream flow through the carburetor and by maximizing the lateral distance between the point of fuel dispersion and the carburetor airstream when the engine throttle control is set for low speed operation. More particularly, the subject invention incorporates all of the advantages of a single point source fuel dispersion system but improves the operation thereof by providing much more accurate control over the flow of fuel in response to a variety of engine conditions.

Another object of this invention is to provide airstream control means for controlling the lateral distance between the carburetor airstream and the point of fuel injection and dispersion in dependence upon the setting of the engine throttle control. The airstream control means is formed by at least one adjustable plate adapted to move laterally across the airstream passage of a carburetor to increase the lateral distance between the fuel dispersion point and the airstream when the throttle control is adjusted for less engine speed and for permitting a decrease in lateral distance between the fuel dispersion point and the airstream when the throttle control is adjusted so as to increase engine speed. In one possible embodiment, the adjustable plate is provided with at least one small aperture adjacent the leading edge thereof, whereby the airstream is constrained to pass through a small cross sectional area when the plate is moved to a low speed position thereby resulting in a higher velocity airstream. The fuel and air mix the same way under all conditions since the device maintains a desired configuration at all times designed to cause a homogenous air/fuel mixture.

Yet another object of this invention is to provide a computer controlled fuel system including a threshold means for providing additional fuel and/or water to the carburetor airstream when sensed engine condition goes beyond a predetermine threshold level. Additional fuel may also be caused to be injected by the threshold means whenever the rate of change of manifold pressure exceeds a predetermined limit.

Another object of this invention is to provide water injection into the airstream entering the intake manifold of an internal combustion engine equipped with a computer controlled fuel system whenever the manifold pressure rises above or the rate of change of manifold pressure exceeds a predetermined level.

These and other objects of the present invention will become readily apparent upon a consideration of the following specification and claims taken in conjunction with the accompanying drawings.

DESCRIPTION OF THE PREFERRED EMBODIMENTS

Figure 1:
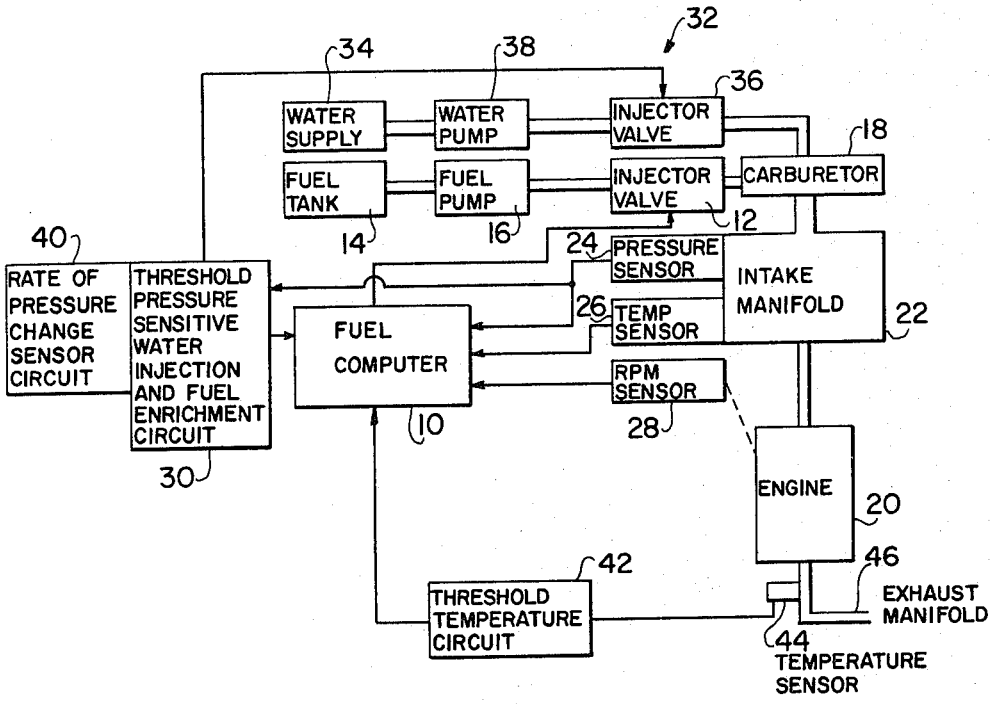
FIG. 1 is a diagram of the computer controlled fuel system designed according to the subject invention.

FIG. 1 is a schematic illustration of the overall computer controlled fuel system of the subject invention combined with an internal combustion engine. More particularly, FIG. 1 includes a number of additions to and modifications of the computer controlled fuel system described in Applicants' application Ser. No. 293,377 filed Sept. 29, 1972, entitled COMPUTER CONTROLLED SONIC FUEL SYSTEM now U.S. Pat No. 3,893,434. The basic purpose of the various additions and modifications illustrated in FIG. 1 is to produce a computer controlled fuel system which permits an internal combustion engine to operate on a very lean fuel/air ratio while at the same time improving performance during certain critical stages in the control of an internal combustion engine such as start-up, warm-up and acceleration. Although a more detailed description of the operation of the fuel computer system is disclosed in the above noted co-pending application, operation of the basic system will be summarized briefly. Fuel computer 10 is adapted to control the operation of an injector valve 12 supplied with fuel from a tank 14 by means of a fuel pump 16 so as to control the amount of fuel fed into a carburetor 18 in response to signals representative of the operating condition of internal combustion engine 20. As is illustrated in FIG. 1, the fuel/air mixture formed in carburetor 18 passes to engine 20 via an intake manifold 22. The pressure and temperature of the fuel/air mixture within the intake manifold are sensed by pressure sensor 24 and temperature sensor 26, respectively, from which signals representative of these respective quantities are sent to the fuel computer 10. An rpm speed sensor 28 connected with the fuel computer may also be provided for producing a signal representative of engine speed.

Although the computer controlled fuel system is outlined above is capable of significantly improved results over conventional mechanically controlled fuel systems, certain deficiencies in operation occur when the fuel computer is set to achieve pollution abatement and fuel economy by providing a very lean fuel/air ratio. In particular, during the start-up and idle of the engine, the fuel is incompletely entrained in the airstream passing at a normal velocity through the carburetor since the fuel particles, even if dispersed by a special dispersion surface as disclosed in U.S. Pat. No. 3,893,434 include liquid particles having a weight at least eight times greater than the air thereby causing some of the fuel particles to impinge upon the walls of the carburetor instead of being entrained in the airstream passing through the carburetor. During normal operation, this problem is somewhat alleviated by the fact that the carburetor and intake manifold walls are at a sufficiently high temperature to cause vaporization of most of the components of the fuel. However, during and immediately after start-up, the carburetor walls are still cold, thereby necessitating some additional means whereby better entrainment of the fuel may be brought about. Carburetor 18 as illustrated more fully in FIGS. 2–6 is adapted to overcome these problems and will be discussed more fully below.

FIG. 1 further discloses a threshold pressure sensitive water injection and fuel enrichment circuit 30 adapted to receive the signal produced by the pressure sensor 24 so as to produce an output signal adapted to cause additional fuel flow to the carburetor upon detection of a pressure within the intake manifold above a predetermined level. By this arrangement significantly improved acceleration characteristics may be obtained when the fuel computer is adjusted to normally provide an extremely lean fuel/air ratio to the intake manifold. Of course increased fuel flow to carburetor 18 may result in some undesirable pollutants. This effect is ameliorated by the provision of water injection means 32 actuated upon the pressure level within the intake manifold rising above a predetermined level to cause water from water supply 34 to be injected into carburetor 18 by an injector valve 36 and water pump 38. Even better results have been obtained by sensing the rate of change of pressure within the intake manifold to add additional fuel enrichment proportional to the rate of change of pressure. As will be discussed in detail below, circuit 40 is adapted to perform this additional function.

It has further been found desirable to enrich the fuel-/air ration supplied to engine 20 during the engine start-up and warm-up periods. A circuit adapted to accomplish this purpose is illustrated in block diagram form in FIG. 1 as a threshold temperature circuit 42. This circuit receives a signal from temperature sensor 44 mounted to sense the temperature of exhaust gases within the exhaust manifold 46 so as to provide a signal to the fuel computer whenever the temperature from the exhaust gases is below a predetermined level.

Figure 2:
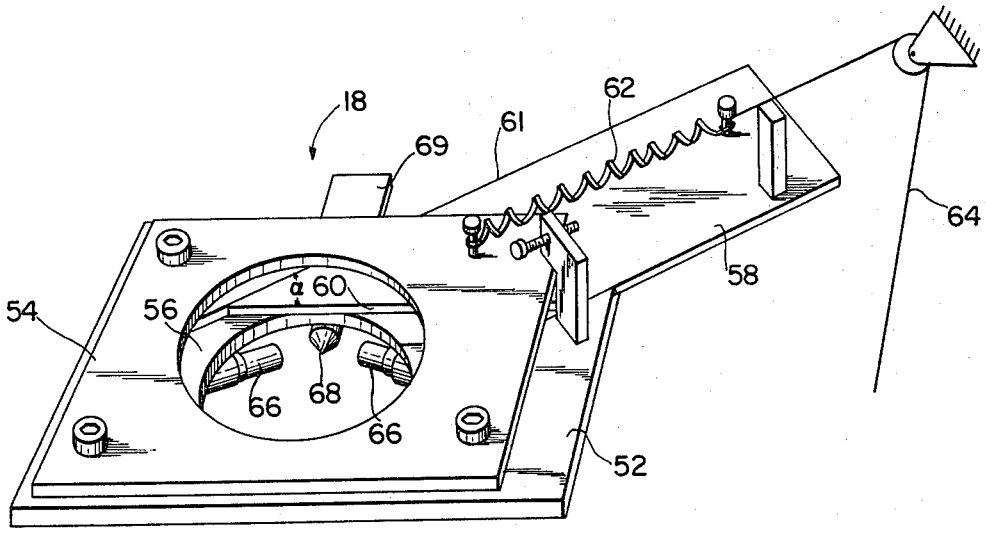
FIG. 2 is a perspective view of the low profile carburetor employed in the system illustrated in FIG. 1 including an adjustable plate adapted to be variably positioned across the airstream passage of the carburetor.
Figure 3:
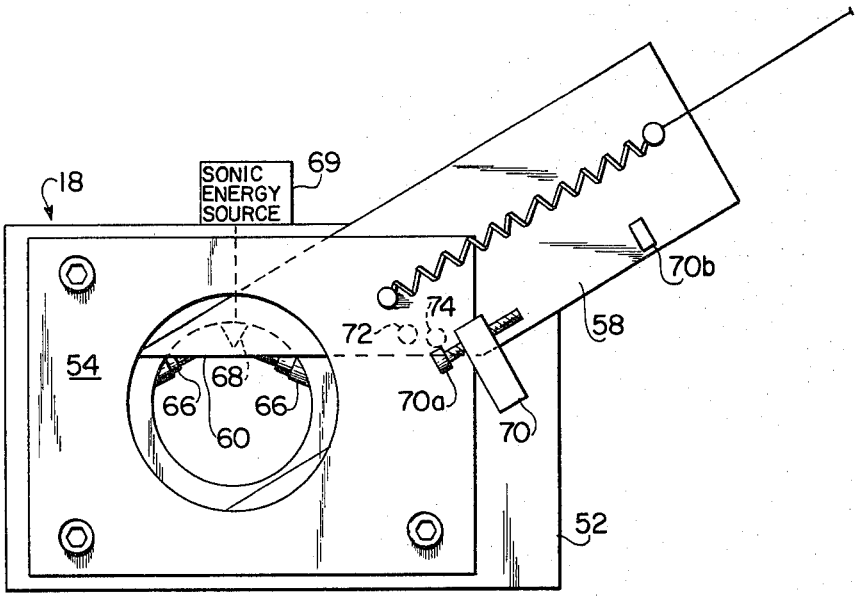
FIG. 3 is a top elevational view of the low profile carburetor illustrated in FIG. 2 wherein the adjustable plate is fully retracted acting as a shroud over the injector and a dispersion device.
Figure 4:
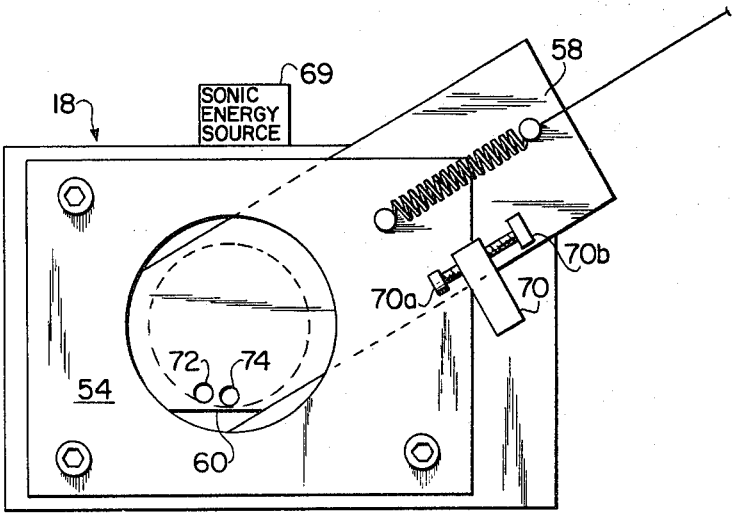
FIG. 4 is a top elevational view of the low profile carburetor according to the subject invention wherein the adjustable plate has been moved to a position adapted to bring about low speed operation of an internal combustion engine with which the carburetor is combined, whereby the airstream is constrained to pass through small apertures located adjacent the leading edge of the adjustable plate.
Figure 5:
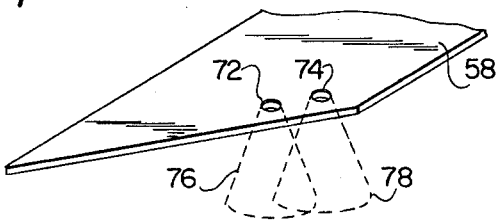
FIG. 5 is a perspective view of the adjustable plate employed in the low profile carburetor illustrated in the previous figures wherein the air flow pattern created by a pair of apertures formed in the adjustable plate of the carburetor is illustrated.

Attention is now directed to FIGS. 2–4 which disclose the low profile carburetor 18 of FIG. 1 in more detail. In particular FIG. 2 is a perspective view of the low profile carburetor 18 including first and second plates 52 and 54 containing aligned apertures for forming a passage means adapted to create an airstream passage for an airstream passing into the intake manifold 22 of the internal combustion engine. A groove 56 is formed in the surface of first plate 52 facing second plate 54 and is configured to receive a slidably adjustable plate 58. Groove 56 opens into the aperture of first plate 52 so as to permit the leading edge 60 of plate 58 to move across the lateral dimension of the airstream passage formed by the apertures of first and second plates 52, 54. The leading edge 60 is formed at an acute angle $\alpha$ with respect to the longer side edge 61 of plate 58 to accommodate the positioning of the dispersion surface and fuel injectors although other configurations are possible such as will be discussed with regard to the FIG. 4 embodiment. Adjustable plate 58 is spring biased by a spring element 62 toward a position in which the adjustable plate substantially covers the air passage of the low profile carburetor 18.

The adjustable plate 58 is connected with a throttle control (only partially illustrated in FIG. 2) including a throttle control cable 64 which is adapted to withdraw the adjustable plate 58 against the bias of a spring element 62 so as to open the air passage of the carburetor. In this way, adjustable plate 58 performs the same function as a butterfly throttle plate in a conventional carburetor. The configuration and use of a plate such as adjustable plate 58 permits an important additional function, however, which is to laterally divert the airstream passing through the carburetor airstream passage. By performing this function, the adjustable plate 58 (which may be considered a movable diverter) causes a greatly improved entrainment of dispersed fuel during engine idling by virtue of the fact that the carburetor airstream is diverted from contact with a fuel dispersion surface 68 as described below and that the greatest possible lateral distance is created between the point of fuel dispersion and the passage of the airstream through the carburetor within the constraints imposed by the size of the airstream passage of the carburetor. As can be seen quite clearly in FIG. 2, a pair of fuel injector nozzles 66 may be provided immediately below first plate 52 and are directed against a dispersion surface 68 which functions to break-up and disperse the injected fuel in a manner which is thoroughly disclosed and discussed in applicants' above noted co-pending application. Surface 68 may be merely passive (stationary) or, as disclosed in U.S. Pat. No. 3,893,434, surface 68 may be active (vibrating) when connected with a sonic energy source 69. Surface 68, thereby, serves to create a dispersion point within the low profile carburetor which is positioned adjacent one side of the airstream passage diametrically opposite that portion of the airstream passage which is last covered by the adjustable plate 58 as it moves toward the low speed closed position. The lateral separation of the fuel dispersion point from the airstream during low speed operation of the internal combustion engine has been found to be extremely effective in causing complete entrainment of the dispersed fuel in the airstream as it passes into the intake manifold of the engine. At higher speed operation separation of the airstream from the dispersion point becomes less critical due to the higher volume of the airstream which effects more complete entrainment of the dispersed fuel.

FIG. 3 is a top elevational view of the low profile carburetor in which the adjustable plate 58 has been fully withdrawn for high speed operation of the engine. In this position, leading edge 60 of plate 58 operates as a shroud to divert the carburetor airstream from the dispersion surface 68 and injector nozzles 66 in the same manner as the stationary shroud disclosed in U.S. Pat. No. 3,893,434. Note that the carburetor 18 may be provided with an adjustable stop 70 for permitting the idle position of the adjustable plate to be predetermined by means of a set screw **70*a* and stationary stop 70*b* mounted on plate 58**.

FIG. 4 discloses the configuration of the low profile carburetor 18 when the adjustable plate is in the low speed, closed position. The leading edge 60 of the adjustable plate 58 is provided with a pair of apertures 72, 74 located diametrically opposite the dispersion point (surface 68) to thereby place the maximum lateral distance between the fuel dispersion point and the airstream passing through the carburetor during low speed operation of the engine. As more fully disclosed in FIG. 5, apertures 72 and 74 create a pair of cone shaped airstream patterns 76 and 78 having their apexes located within apertures 72 and 74, respectively. Apertures 72 and 74 have a small area cross section so as to insure a high velocity airstream even at idle speeds of the internal combustion engine. Of course, the number of apertures is not critical since a single aperture or multi-aperture may be employed although a pair of apertures has been found to give the best results.

Figure 6:
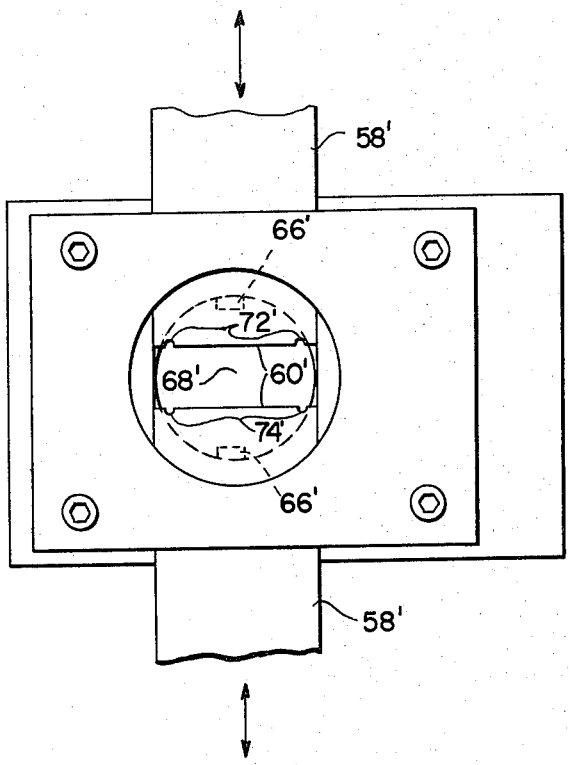
FIG. 6 is a top elevational view of a modified embodiment of the low profile carburetor schematically illustrated in FIG. 1 wherein a pair of fuel injectors are arranged so as to inject fuel toward a common control dispersion point within the airstream passage of the carburetor and a pair of slidably adjustable plates are employed to control the lateral position of the carburetor airstream.

FIG. 6 illustrates an alternative embodiment of the low profile carburetor of FIGS. 2–5 wherein the single adjustable plate has been replaced by a pair of slidably adjustable plates 58' adapted to move laterally across the airstream passage of the carburetor. A further modification illustrated in FIG. 6 involves the positioning of the fuel injector nozzles 66' so that fuel pulses released from both nozzles will collide with the airstream and with the opposite side walls of the airstream passage. When the nozzles are arranged in this manner, the need for a dispersion surface as illustrated in FIGS. 2–4 is eliminated. The leading edges 60' of plates 58' are adapted to meet along a line passing through the center of the carburetor air passage just above point 68' whenever the throttle is adjusted for engine idle. Mating notches 72' and 74' are formed in the leading edges 60' of plates 58' which notches cooperate to create airstream forming apertures when the throttle is adjusted for engine idle. Notches 72' and 74' are placed adjacent the lateral edges of plates 58' so as to separate the airstream from the fuel dispersion point by a maximum lateral distance. Of course notches 72' and 74' may be replaced by one or more apertures formed in the leading edges of either or both plates 58'. The embodiment of FIG. 6 utilizes a direct spray from the injector 66' with the appropriately placed high velocity air shears created by the pair of slidable plates 56' to entrain the spray which has had a chance to spread out uniformly from its source. Injectors 66' may be operated to produce fuel pulses alternately, together or alternately with overlap.

Figure 7:
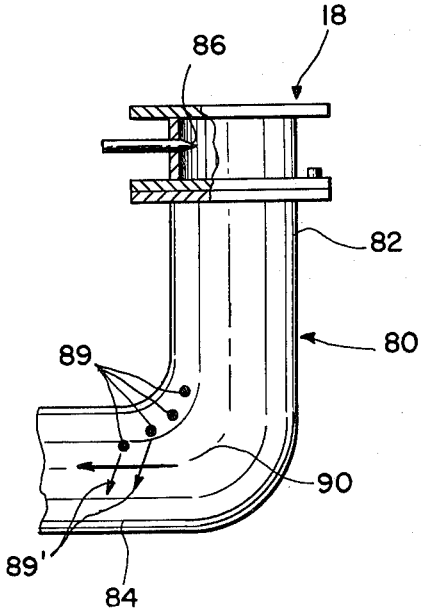
FIG. 7 is a schematic illustration of the most desirable arrangement of the low profile carburetor when mounted on an L-shaped intake manifold so as to provide optimum fuel dispersion within the airstream entering an internal combustion engine.

Turning now to FIG. 7, a low profile carburetor 18 constructed in accordance with the subject invention is illustrated as being mounted on an L-shaped intake manifold 80 (such as is generally employed on a straight line 6 cylinder engine) having a vertical leg 82 connected with a horizontal leg 84. The low profile carburetor is arranged atop the intake manifold in such a manner that the dispersion point 86 is positioned adjacent the same side of vertical leg 82 as the extended direction of horizontal leg 84.

At higher engine speeds the higher air velocity and volume confine fuel particles to the side of the air stream on which the dispersion point 86 is located. If there were no change in the airstream direction, unequal distribution would result in an air/fuel mixture which is non-homogenous. However, by placing the dispersion point 86 on the side of the vertical leg 82 from which horizontal leg 84 extends, more even distribution of the fuel within the air stream 90 results. More particularly the heavier (layer) fuel particles (represented by dots 89) are forced by centrifugal forces opposing the change in direction of the airstream in the direction of arrows 89'. Obviously, this movement of the fuel particles has the effect of more uniformly entraining the fuel within the airstream 90 of the manifold.

Figure 7A:
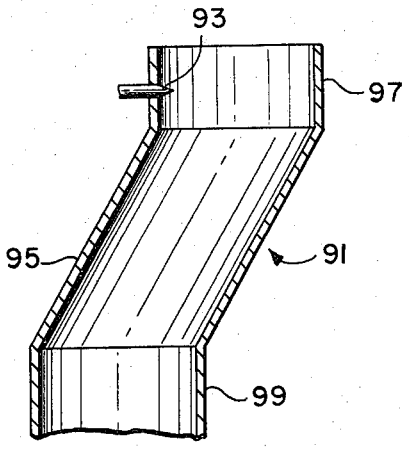
FIG. 7A is a cross-sectional view of a low profile carburetor and intake manifold for use on a V-8 engine.

FIG. 7A illustrates a modified embodiment of an intake manifold adapted to maximize the advantages of the subject low-profile carburetor when employed on a V-8 internal combustion engine. More particularly FIG. 7A illustrates an intake manifold 91 having a dispersion surface 93 functioning in the same manner as dispersion surface 68 of FIGS. 2–4, wherein manifold 91 includes an angularly oriented intermediate section 95 extending from the vertically oriented upper section 97 containing dispersion surface 93 to vertically oriented lower section 99 which leads to the left and right intake manifolds commonly employed on a V-8 engine. By placing the dispersion surface 93 on the side of the manifold 91 toward which section 95 is angularly oriented as illustrated in FIG. 7A, advantage can be taken of the same phenomenon described above relative to the embodiment of FIG. 7 whereby the fuel is more uniformly distributed within the airstream passing through the intake manifold.

Figure 8:
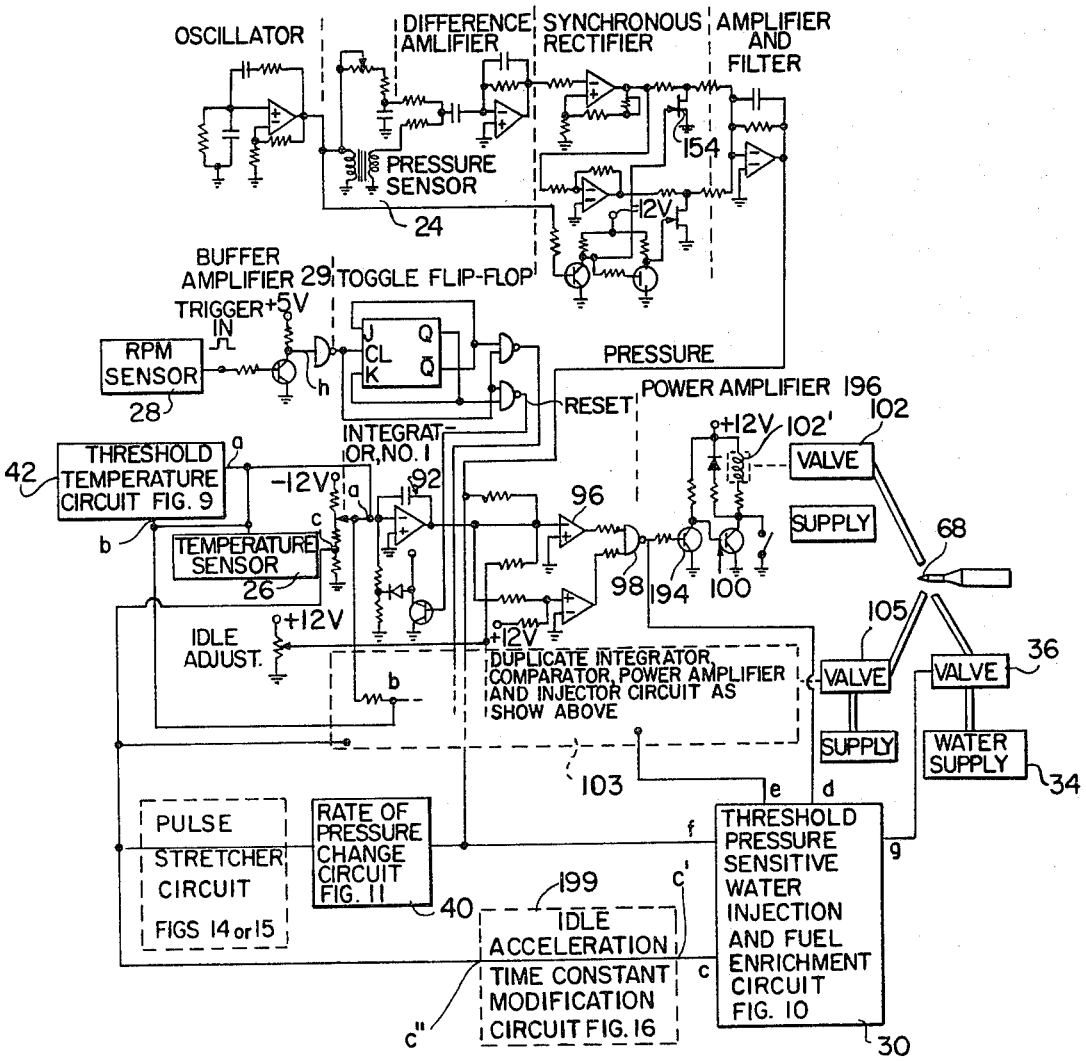
FIG. 8 is a detailed circuit diagram of the fuel computer illustrated in FIG. 1 including the associated fuel enrichment threshold circuitry employed in the fuel system of the subject invention.

Turning now to the circuit modifications, disclosed diagrammatically in FIG. 1, reference is made to FIG. 8 wherein the fuel computer 10 of FIG. 1 is disclosed in much greater diagrammatic detail. As set forth in U.S. Pat. No. 3,893,434, computer 10 is designed to meter the proper amount of fuel to a dispersion point in the carburetor for more uniform mixing with the airstream thereby to minimize combustion pollution products due to an overly rich mixture while at the same time insuring sufficient fuel for proper engine performance. To produce optimum combustion, the fuel/air ratio should be such that the fuel is completely burned to minimize the production of carbon monoxide due to incomplete combustion and to reduce the amount of unburned hydrocarbons being admitted to the combustion by-products. To satisfy this criteria in an internal combustion engine, the fuel/air ratio should normally be maintained at an optimal level for all similar operating conditions of the engine. Thus while the optimal fuel/air ratio under certain operating conditions may not be the optimal ratio for other operating conditions, the fuel/air ratio should be controllable so that with any given conditions the carburation system is capable of delivering a predetermined optimal ratio of fuel to air to the engine. Since the volume of air required by the engine is proportional to the manifold temperature and engine speed and inversely proportional to the intake manifold pressure, the fuel computer 10 is adapted to receive signals representative of these quantities so as to meter the flow of fuel in response thereto to maintain the desired fuel/air ratio. With reference to FIG. 8, the fuel computer disclosed in U.S. Pat. No. 3,893,434 is illustrated wherein an integrator 92 is operated on a cyclic basis to integrate a signal produced by intake manifold temperature sensor 26 to produce an increasing output signal which is compared to a variable voltage from sensor 24 representative of manifold pressure in comparator circuit 96 to produce a variable width output pulse from gate 98. The signal from gate 98 is, in turn, amplified in amplifier circuit 100 to open fuel valve 102 for a length of time dependent upon the width of the pulse from gate 98. The cyclic operation of integrator 92 is brought about by a pulsed signal from rpm sensor 28 wherein the repetition rate of the pulsed signal is proportional to engine speed. A duplicate integrator, comparator, power amplifier and injector circuit 103 is illustrated within dotted lines for operating duplicate valve 105. As is discussed in U.S. Pat. No. 3,893,434, the integrators in each circuit may be reset alternately or simultaneously and valves 102, 105 may be used to inject liquids other than fuel such as water. For purposes of this disclosure, however, it will be assumed that the pulsed signal from rpm sensor 28 is applied simultaneously to integrator 92 of both circuits to effect simultaneous injection of fuel pulses to a dispersion point 68 within the airstream passage of carburetor 18.

As can be seen by this very brief description and as more fully discussed and disclosed in U.S. Pat. No. 3,893,434, fuel computer 10 can be adjusted to provide a predetermined ratio of fuel to air in response to speed, temperature, and pressure signals from the internal combustion engine.

FIG. 8 further includes a schematic representation of circuit threshold means designed in accordance with the subject invention for overcoming certain deficiencies in the performance of an internal combustion engine which may result when the engine is equipped with the subject fuel computer. More particularly, FIG. 8 discloses a threshold temperature circuit 42 responsive to the temperature of exhaust gases from the internal combustion engine to produce an output signal whenever the temperature of the exhaust gases is below a predetermined amount. This output signal is combined with the temperature signal from sensor 26 so as to tend to increase the amount of fuel supplied by valves 102, 105 during each cycle of integrator 92 when the exhaust temperature is below a predetermined level.

FIG. 8 also discloses a threshold pressure sensitive water injection and fuel enrichment circuit 30 adapted to respond to a signal from the intake manifold pressure sensor 24 to produce an output signal connected with the input circuit of integrator 92 (and the duplicate integrator of circuit 103) so as to provide additional fuel enrichment when the pressure within the intake manifold rises above a predetermined valve. This output signal may be further modified by a rate of pressure change circuit 40 which responds to the rate of change of the signal produced by the intake manifold pressure sensor 24 to produce an output signal upon the rate of change exceeding a predetermined level. The output from the rate of change circuit is combined with the output of enrichment circuit 30 so as to further increase the amount of fuel supplied during each cycle of the integrator 92 and its duplicate. The threshold pressure sensitive water injection and fuel enrichment circuit 30 is also adapted to produce a second output signal at g connected to a water injection means, the details of which will be discussed below.

Figure 9:
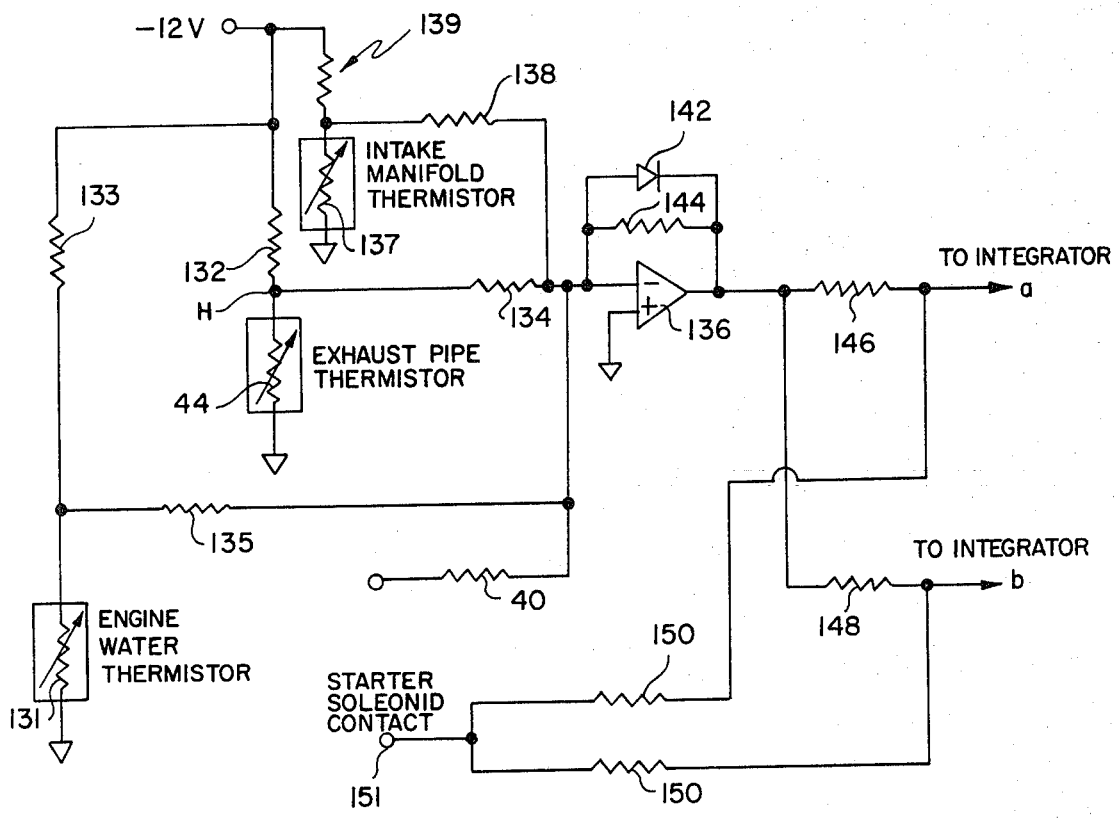
FIG. 9 is a more detailed diagram of the circuit illustrated in FIG. 8 for providing a threshold temperature responsive signal for enriching the fuel/air ratio during start-up and low temperature engine operation.

The threshold temperature circuit 42 disclosed in FIG. 8 is shown in greater schematic detail in FIG. 9 wherein the temperature sensor 44, such as a thermistor, is mechanically mounted to measure exhaust gas temperature and is electrically connected with a negative 12 volt potential supply through a 1.8 K ohm resistor 132 to produce an output signal through a 20 K ohm resistor 134 to the negative terminal of an operational amplifier 136. The desired results require that the temperature sensed should start changing in a warmer direction immediately after the engine is started. For this reason, the exhaust gas temperature of an internal combustion engine should be measured near the exhaust manifold, but the maximum temperature thereof becomes too hot for many types of temperature sensors such as thermistors. This problem is solved by placing the thermistor in indirect contact with the exhaust pipe and placing adequate cooling fins on the thermistor to thereby produce a fast initial rise in temperature while limiting the maximum temperature to a safe value.

Also connected to the negative input of operational amplifier 136 through a resistor 138 is a second temperature sensor 137 such as a thermistor located in the intake manifold between the negative 12 volt supply and ground. A diode 142 and a 10 K ohm resistor 144 provide a feedback from the output of the operational amplifier 136 to the negative input. The resistance values of the resistors in FIG. 9 are chosen to cause the output of the operational amplifier 136 to go from a positive voltage (approximately 8 volts) at room temperature toward a negative voltage as the thermistor temperature increases. Diode 142 limits the maximum negative output of the amplifier to approximately minus 0.6 volts. Two 79 K ohm resistors 146, 148 are connected to the input of integrator 92 and its duplicate in circuit 103, respectively, to cause the integrator slope to decrease at temperatures below the preselected level thereby causing fuel enrichment. The characteristics of the circuit of FIG. 9 as determined by the resistor values and amplifier gains are designed to match a pre-measured fuel enrichment scheduled as a function of temperature.

During engine starting, additional fuel enrichment is desirable and may be provided by connecting a pair of 316 K ohm resistors 150 with the inputs of the integrators, respectively, and the starter solenoid contact 151 of the engine. Since the starter solenoid is energized only during starting, additional enrichment is provided only during this time period. Again the resistors are chosen so as to provide a pre-selected amount of fuel enrichment.

The input temperature signal for the threshold temperature circuit of FIG. 9 may be derived by sensing a temperature at locations other than the intake and exhaust manifolds as discussed above. For example, a temperature sensor may be arranged to sense the water temperature of the engine such as illustrated in FIG. 9 wherein an engine water temperature sensor 131 such as a thermistor is connected in series with a resistor 133 between ground and the power supply. Variations in the resistance of sensor 131 are reflected at the negative input of operational amplifier 136 through a resistor 135. The water temperature increases more slowly than the exhaust or intake manifold temperature. Accordingly with sensor 131 connected as illustrated, the enrichment during warm up will be extended to cover a longer duration (exceeding three minutes).

In order to give proper enrichment, resistors 134, 135 and 138 must be selected with the appropriate resistive values which may be determined empirically to give best engine performance.

Figure 10:
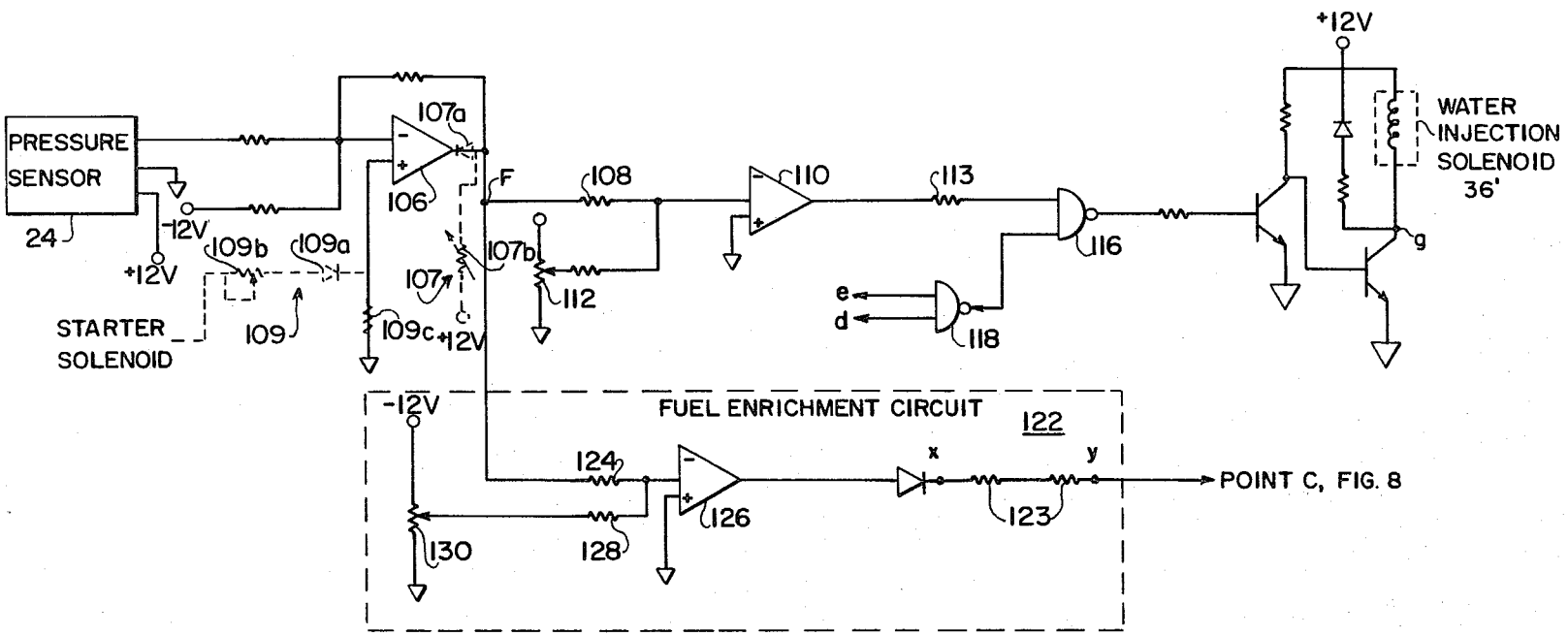
FIG. 10 is a more detailed diagram of the circuit for threshold pressure sensitive water injection and fuel enrichment.

FIG. 10 discloses the threshold pressure sensitive water injection and fuel enrichment circuit 30 in greater detail wherein pressure sensor 25 (such as a pressure transducer manufactured by National Semiconductor Corp, part number LX 1600A is used for providing a signal indicative of intake manifold pressure. An operational amplifier 106 connected to the output of pressure transducer 24 is provided to produce a DC voltage proportional to pressure. This pressure voltage is in turn connected through a 10 Kohm resistor 108 to the negative input of operational amplifier 110. A 5 kohm potentiometer 112 is also connected to the negative input of operational amplifier 110 to set the cut-in pressure for water injection. As acceleration of the engine takes place, ther pressure voltage goes more negative until the output of the operational amplifier 110 goes positive. The output of amplifier 110 is in turn coupled through a 10 Kohm resistor 113 to the input of a Nand gate 116. The other input of this Nand gate 116 is received from a second Nand gate 118 having inputs received from the outputs of logic gate 98 and its duplicate in circuit 103 of the fuel computer 10. The result is that when either of the two fuel injectors are operated and the pressure comparator 110 output is positive, the solenoid 36' for operating water injector valve 36 is energized to produce a pulse of water into the airstream passing through carburetor 18. This circuit arrangement has particular utility when the integrators of the circuit in FIG. 8 are alternatively actuated so that water injection may occur continuously when fuel pulses increase in time sufficiently to overlap. The circuit of FIG. 10 also includes a fuel enrichment circuit 122 responsive to the pressure voltage supplied through a 10 Kohm resistor 124 to the negative input of an operational amplifier 126. The same negative input is also connected through a 10 Kohm resistor 128 to a 5 Kohm potentiometer 130 which is connected to a minus 12 volt supply in order to set a threshold voltage level for operation of the fuel enrichment circuit of circuit 30. As the pressure voltage decreases during acceleration, the output of the operational amplifier 126 goes from maximum negative to maximum positive when the threshold level set by potentiometer 130 is reached. The output from the enrichment portion 122 is connected at point C of the circuit illustrated in FIG. 8. The circuit of FIG. 10 is, thus, designed to provide enrichment during the onset of acceleration. The manifold pressure of a conventional internal combustion engine is approximately 10–15 inches of mercury vacuum when the engine is operating at idle or light loads at various speeds. When an automobile accelerates the intake manifold pressure rises toward atmospheric pressure. During deceleration the values may rapidly drop to 20–25 inches of mercury vacuum. To prevent an excessively lean airfuel ratio during deceleration and the resulting mis-fire and excessive hydrocarbons, a clamp circuit 107 (illustrated in dashed lines) may be provided at the output of operational amplifier 106. In particular, the clamp circuit 107 includes a diode 107*a* and variable resistor 107*b* connected as illustrated. If the output of the operational amplifier 106 goes more positive than the voltage at point F, diode 107*a* becomes reverse biased and the voltage is clamped at this particular voltage.

As a further possible modification of FIG. 10, a de-enrichment circuit 109 may be provided (illustrated in dashed lines) in order to cause reduced fuel input during the time that the starter motor is operated. In particular, de-enrichment circuit 109 includes diode 109*a* and variable resistor 102*b* connected in series between the starter motor solenoid and the plus input of amplifier 106. A resistance 109*c* is also placed between the plus input of amplifier 106 and ground all as illustrated in FIG. 10.

Figure 10A:
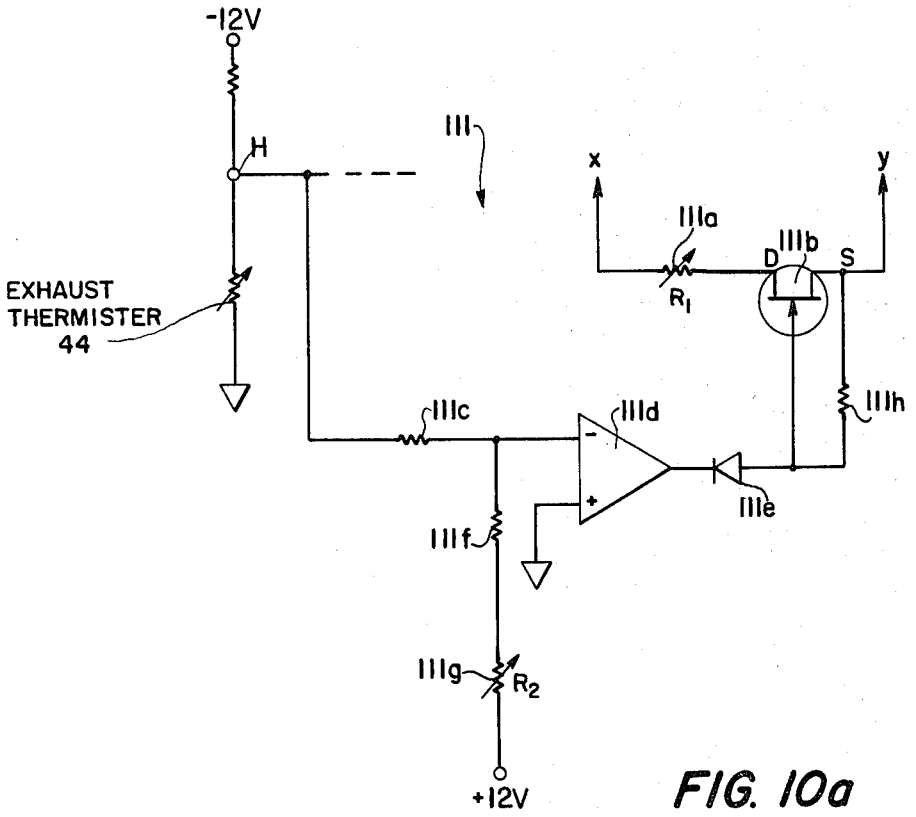
FIG. 10*a* is a early warm up circuit for modifying the operation of the circuit illustrated in FIG. 10.

Additional improvement in operation of the circuit of FIG. 10 may be derived by the addition of an early warm-up circuit 111 as illustrated in FIG. 10*a* wherein conductors terminating at X and Y are adapted to be connected to points marked X' and Y' in the circuit of FIG. 10. The circuit of FIG. 10*a* includes a variable preset pressure resistor 111*a* in series with an FET(2N3819) 111*b* between points X and Y, whereby resistor 111*a* is switched into the circuit of FIG. 10 during early warm-up for increased enrichment while the engine is cold as sensed by exhaust thermister 44. A 47K Ω resistor 111*c* is connected between point H of the circuit of FIG. 9 and the negative input of operational amplifier 111*d* the output of which is connected to the gate of FET 111*b* by diode 111*e*. A second 47K Ω resistor 111*f* and variable resistor 111*g* is also connected between the negative input of amplifier 111*d* and the +12 v supply while the positive input of amplifier 111*d* is grounded to form a comparator whereby the output of the operational amplifier 111*d* changes from a positive to a negative valve as the resistance of the exhaust thermistor 44 decreases (which results when the exhaust pipe temperature increases). If the output is positive, diode 111*d* is biased off, FET 111*b* is on, effectively connecting resistor 111*a* from X to Y. Correspondingly, negative voltage is connected to the gate of the FET turning it off which disconnects 111*a* from the circuit. A resistor 111*h* has a resistance of 1 M Ω to provide leakage current from the gate. With proper adjustment of resistor 111*g*, the extra enrichment produced by 111*a* can be switched in for a predetermined temperature range of the exhaust, thus providing added enrichment during warm-up.

Still further refinement of the overall operation of the subject system can be achieved by sensing the rate of change of pressure within the intake manifold and using this rate of change signal in controlling fuel enrichment during the acceleration of an automobile. A rate of change circuit 40 is illustrated in FIG. 8 and will be described in greater detail with reference to FIG. 11.

The voltage output at point f from the pressure transducer amplifier which senses the intake manifold pressure is the input to a differentiator 154 adapted to produce a rate of change output signal equal to $$k\frac{dv(t)}{dt}$$

where v(t) is a time varying input signal and k is a constant. The output of the differentiator is a voltage whose magnitude is largest during the fastest time rate of change of the intake manifold pressure. As the intake manifold pressure increases, the output voltage is negative. Similarly, as the intake manifold pressure decreases (increases in vacuum during deceleration) the output voltage is positive. When the intake manifold pressure is steady, the output voltage is zero. Amplifier 159 and associated equal input (155) and feedback (157) resistors provide unity gain inversion of the differentiator output voltage. The output voltage from the unity gain inverter 159 may be applied to point c (FIG. 8) of the fuel computer thereby to cause integrator 92 to provide either a richer or a leaner mixture from the normal setting during the corresponding onset of acceleration or deceleration.

Figure 11:
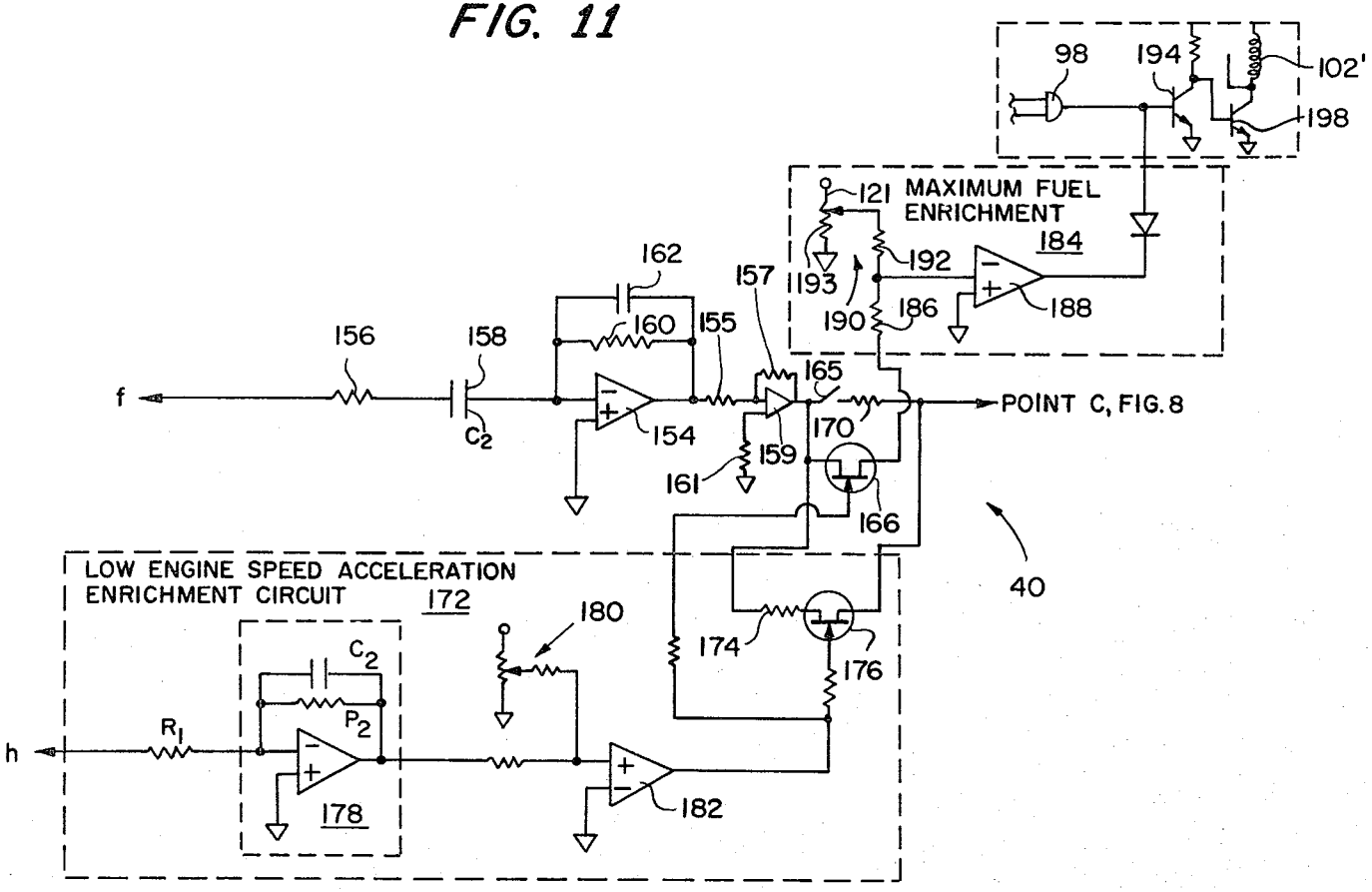
FIG. 11 is a schematic illustration of a rate of change circuit for enriching the fuel supply to the low profile carburetor responsive to the rate of change of pressure within the intake manifold.

With reference to FIG. 11, the pressure signal f is applied to the differentiator 154 through a 13 Kohm resistor 156 ($R_2$) and 1.5 uf capacitor 158 ($C_2$). The output of the differentiator is fed back to the input through a parallel connection of a 100 Kohm resistor 160 ($R_1$) and a 0.22 uf capacitor 162 ($C_1$). The output is connected to a unity gain inverter whose output is connected to point c of the computer circuit illustrated in FIG. 8 through a 3.3 Kohm resistor 170. The RC constant of elements 160 and 158 is equal to −k in the above equation and the factors $1/R_1C_1$ and $1/R_2C_2$ are equal to $W_1$ and $W_2$ where $$W_1=2\pi f_1 \text{ and } W_2=2\pi f_2.$$

The frequencies $f_1$ and $f_2$ are the high frequency cut off points which are designed into the circuit to attentuate the high frequency noise. The values chosen give cut off points which are designed into the circuit to attenuate the high frequency noise. The values chosen give cut off frequencies between 5 and 10 hertz for this particular application. Switch 165 acts to disable the differentiator enrichment when opened. This switch may be activated by a number of variables such as the carburetor linkage, transmission linkage, altitude pressure switch or temperature pressure switch thereby adding additional flexibility to the enrichment circuitry.

Additional improvement in the operation of circuit 40 can be achieved by the provision of a low engine speed acceleration enrichment circuit 172 which operates to switch additional resistance 174 in parallel with resistor 170 by means of an FET transistor 176. In particular, circuit 172 receives pulses from the buffer amplifier 29 of FIG. 8 at point h and filters these pulses by means of standard filter circuit 178 to produce a voltage proportional to engine speed. This voltage is then compared with a pre-set voltage determined by potentiometer 180 by means of a comparator 182. When the voltage from filter 178 falls below the pre-set value determined by potentiometer 180, comparator operates to switch in additional resistance at low engine speed to increase the acceleration enrichment as compared to acceleration enrichment at high speed. This added enrichment improves the performances when accelerating from an idle or dead stop position. The use of a rate of change circuit is optional with the disclosed invention and is included so as to enable an even finer adjustment to the operating characteristics of an internal combustion engine provided with a fuel computer adjusted to provide a very lean fuel/air ratio.

FIG. 11 also discloses a maximum fuel enrichment circuit 184 including a 10 Kohm resistor 186 connected with the negative input of a comparator 188 whose input is also connected with a potentiometer 190 made up of 10 Kohm resistor 192 and 5 Kohm variable resistor 193. The output of comparator 188 is connected to the base of transistor 194 (2 N 3704) within the existing power amplifier 196 illustrated in FIG. 8 for operating valve solenoid 102' through transistor 198 (2 N 3055). Below a pre-set engine speed FET 166 is closed so that the output of the FET 166 is connected to the comparator 188 such that the voltage presented to comparator 188 is proportional to the rate of change of intake manifold pressure produced by differentiator 154. As the pressure rises from high vacuum toward atmospheric, the output voltage of the unit gain inverter (159) goes positive. When this voltage is greater in magnitude than the magnitude of the negative voltage set by variable resistor 193, the comparator 188 will go to negative 12 volts. This causes transistor 194 to turn off, which in turn opens valve 102, allowing fuel to flow. At all other times the injector drive circuitry operates in a normal manner.

Figure 12:
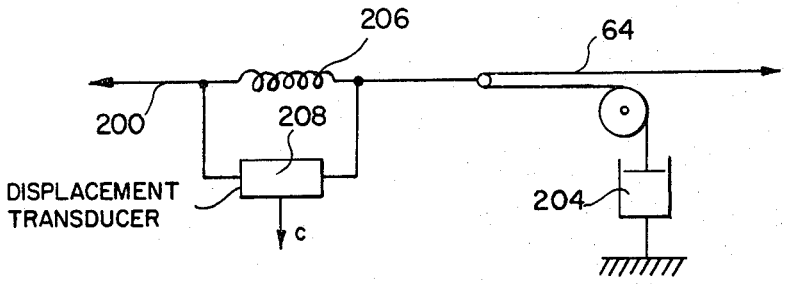
FIG. 12 is an electro-mechanical circuit for improving the acceleration performance of an engine equipped with the fuel computer of this invention.
Figure 13:
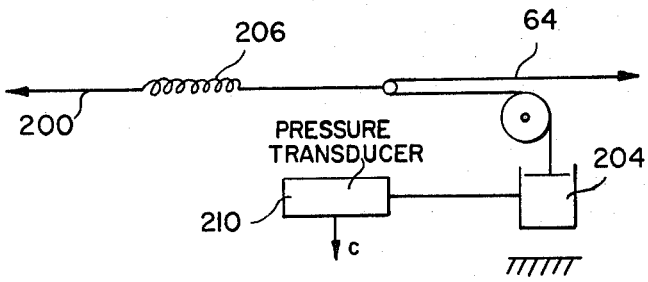
FIG. 13 is a modified embodiment of the electro-mechanical circuit of FIG. 12.

FIGS. 12 and 13 are directed to electro-mechanical anticipation circuits which respond to throttle control or accelerator pedal movement to produce a signal capable of assisting the fuel computer to enhance engine performance during rapid acceleration. In particular, FIG. 12 discloses a cable 200 adapted to be connected at one end to the throttle control and at the other end to the carburetor linkage 64, such as illustrated in FIG. 2 which has been modified to include a dash pot 204. By placing a spring 206 in cable 200, any movement of the throttle first stretches the spring 206 before the dash pot 204 begins to move. The carburetor linkage is attached to one side of the dash pot 204 and is therefore delayed in time from any movement in the throttle control. By sensing the displacement of one end of the spring 206 with respect to the other, such as by means of a displacement transducer 208 (FIG. 12), the velocity in the linkage may be sensed. Alternatively, the pressure of the oil in the dash pot 204 may be sensed by a pressure transducer 210 (FIG. 13) to produce a signal proportional to velocity in the accelerator linkage. The displacement of one end of the spring with respect to the other is proportional to the force on the spring which, incidentally, can be made almost equal to the force on the dash pot by keeping the force required by the carburetor linkage small. The pressure on the oil inside the dash pot is proportional to the force on the dash pot which is, in turn, proportional to the velocity of the movable piston in the dash pot (the cylinder end of the dash pot being fixed to either the automatic chassis or the engine). Therefore, by sensing either the displacement of the spring (FIG. 12) or the pressure on the dash pot (FIG. 13), a signal can be obtained which anticipates the movement of the carburetor linkage. This signal can then be connected to the integrator circuit at c (FIG. 8) in the computer to provide enrichment. Of course, during deceleration, this circuit would also send a signal to the computer to cause a leaner fuel-air ratio in anticipation. This would allow fuel on the intake manifold walls to become evaporated thereby preventing an overly rich mixture during the onset of deceleration.

The pulse coming from the above mentioned transducers or the existing acceleration enrichment circuitry (FIG. 11) may be too short in time duration to accomplish the desired results. Therefore, a pulse stretcher circuit illustrated in FIG. 14 for acceleration enrichment may be included, as illustrated in dashed lines (215) in FIG. 8. The pulse output from the acceleration enrichment circuit (FIG. 11) is coupled through diodes 211 to parallel resistor-capacitor circuits 216 and 218. Circuit 216 is for positive pulses encountered during acceleration and circuit 218 is for negative pulses encountered during deceleration. The output of each RC circuit is connected, respectively, to operational amplifiers 212, 214 having a gain of unity. The output of the operational amplifier is then connected through the appropriate resistors 220 or 222 to the integrator input c (FIG. 8). This circuit stretches the pulse in proportion to the product of the resistance times the capacitance (RC) of either circuit 216 or 218. The pulse will decay to within 0.368 of its maximum value in RC seconds.

Figure 15:
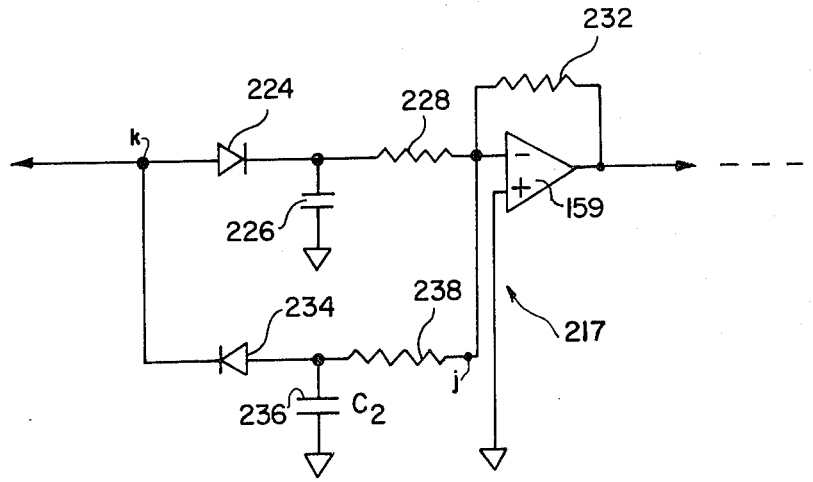
FIG. 15 is a modified embodiment of the circuit illustrated in FIG. 14.
Figure 14:
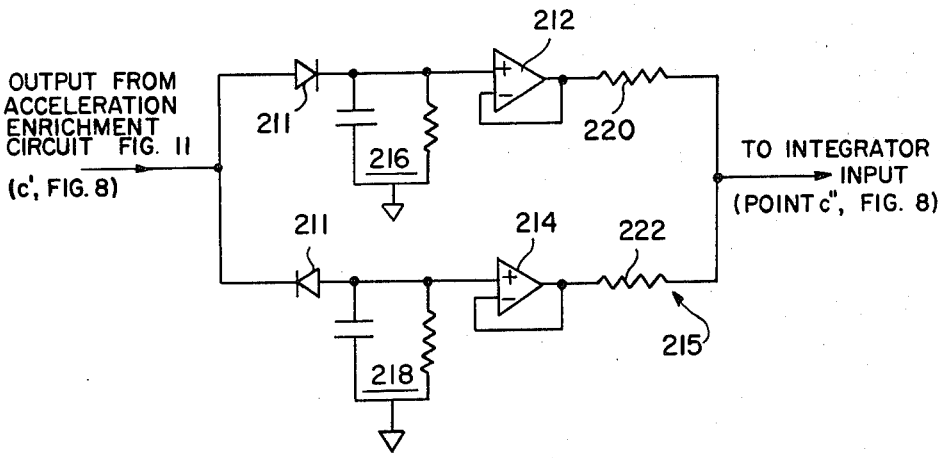
FIG. 14 is a pulse stretcher circuit for lengthening the pulse output from the differentiator illustrated in FIG. 11.

FIG. 15 illustrates an alternative embodiment of the pulses stretches circuit of FIG. 14 using the unit gain inverter (159) of FIG. 11. The diode 224 conducts during the positive pulse to charge capacitor 226 to a voltage approximately equal to the maximum amplitude of the positive pulse. The capacitor 226 then discharges exponentially through resistor 228 with a time constant equal to the product of the resistance of 228 and the capacitance of 226. This voltage is amplified through the operational amplifier 159 with a gain equal to the ratio of the resistance of 228 to the resistance of resistor 232. Negative pulses are coupled through diode 234 to charge capacitor 236. This then decays exponentially through resistor 238.

Figure 16:
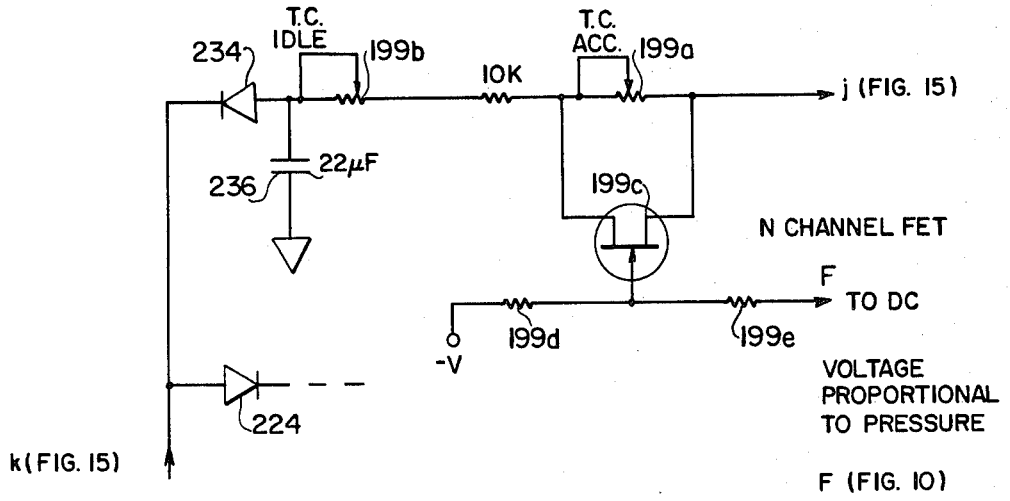
FIG. 16 is an idle and acceleration time constant modification circuit for modifying the operation of the overal circuit illustrated in FIG. 8.

Yet another possible modification of the basic circuit illustrated in dashed lines in FIG. 8 is the inclusion of an idle and acceleration time constant modification circuit 199 connected in the pulse stretcher circuit (217), FIG. 15, from point k to j so as to modify the time constant of integrators No. 1 and 2. Circuit 199, illustrated in detail in FIG. 16, includes a series connection of variable resistors **199*a* and 199*b* with resistor 199*a* being connected in parallel with the source and drain of FET 199*c*. The gate of FET 199*c* is, in turn connected to a voltage divider formed by resistor 199*d* and resistor 199*e*. During FET 199*c* is held at low resistance by means of a manifold pressure voltage being applied to point F taken from point F of FIG. 10 thereby effectively bypassing variable resistor 199*a*. During acceleration the voltage at point F turns FET 199*c* off which has the effect of switching in resistor 199*a*. In between idle and maximum acceleration, FET 199*c*** changes resistance from low to high resistance which provides a smooth transition in the switching process.

An important object of this invention is to modulate the fuel/air mixture under all operating conditions to achieve the leanest possible fuel/air mixture while providing high engine performance. The above described low profile carburetor in combination with the improved electronic fuel computer represents a major advance toward this obviously desirable result.

Even better results may be achieved by supplying air under constant pressure to the intake manifold or mixing area. Any means which is capable of producing this result may be employed such as a pressure sensor in the intake manifold or fuel/air mixing area arranged to produce a signal for controlling the displacement of a pump mounted to supply air to the low profile carburetor of this invention.

While the disclosed system has been found to be reliable, still greater reliability may be achieved by reducing the stress on the magnetostrictive element used to vibrate the aluminum horn (illustrated in U.S. Pat. No. 3,893,434) on which the fuel dispersion surface (illustrated as surface 68 in FIG. 2) is formed. More particularly, it has been found that stress due to coefficient of expansion mismatch may be improved by inserting a steel plate between the ferrite element and the magnetostrictive element. The match between the ferrite and steel plate is good while the match between the steel plate and aluminum horn is not as good but the steel plate is better able to withstand the stress.

We claim:

1. Fuel-air mixing apparatus for an internal combustion engine having an intake manifold and a throttle control for controlling the engine, comprising (a) passage means for forming an airstream passage for directing an airstream into said intake manifold;

(b) fuel injection means for injecting fuel toward a dispersion point located within said airstream passage at which the fuel may be dispersed; and (c) airstream control means for displacing the airstream within said passage to increase the distance between said dispersion point and said airstream when the throttle control is adjusted so as to produce less engine speed and for permitting a decrease in the distance between said dispersion point and the airstream when the throttle control is adjusted so as to increase engine speed.

2. Apparatus as defined in claim 1, wherein said air stream control means includes an adjustable plate mounted for lateral movement through said airstream passage.

3. Apparatus as defined in claim 2, wherein said airstream control means includes a pair of adjustable plates mounted for lateral movement through said passage.

4. Apparatus as defined in claim 2, wherein said adjustable plate includes means for increasing the velocity of said airstream at low engine speeds.

5. Apparatus as defined in claim 4, wherein said means for increasing said airstream velocity includes a portion of said adjustable plate adjacent the leading edge which passes through said airstream passage, said portion containing at least one aperture.

6. Apparatus as defined in claim 5, wherein said plate includes a pair of apertures within said portion.

7. Apparatus as defined in claim 3, wherein said adjustable plates contain corresponding notches formed in the leading edges, said notches being positioned and form apertures adjacent the perimeter of said airstream passage when said adjustable plates and said throttle control is adjusted for low speed operation.

8. Apparatus as defined in claim 1, wherein said fuel injection means includes an electronic fuel computer means for electrically controlling the supply of fuel to said dispersion point in response to engine conditions.

9. Apparatus as defined in claim 8, wherein said fuel injection means includes at least one fuel injection nozzle responsive to signals from said fuel computer means to inject fuel toward said dispersion point.

10. Apparatus as defined in claim 9, further including a fuel dispersion surface located at said dispersion point, said dispersion surface being positioned so as to intercept and break apart the fuel injected into said passage from said fuel injection nozzle.

11. Apparatus as defined in claim 10, wherein said dispersion surface is mounted so as to vibrate, and further including means for vibrating said dispersion surface.

12. Apparatus as defined in claim 2, wherein said passage means includes first and second plates containing aligned apertures, said first plate including a groove formed in its surface adjacent to said second plate, said groove opening into the aperture in said first plate and said adjustable plate being disposed for movement within said groove.

13. Apparatus as defined in claim 1, in combination with an L-shaped intake manifold having an upper vertical leg and a lower horizontal leg connected with said upper vertical leg, said dispersion point being located adjacent the side of said vertical leg from which the lower horizontal leg extends.

14. Apparatus as defined in claim 1, further including an intake manifold for supporting said passage means, said manifold including upper and lower sections having vertically oriented passages connected with said airstream passage, said upper section containing said dispersion point adjacent one side, and an intermediate section having a passage interconnecting the passages of said upper and lower sections and extending in an acute angular direction relative to vertical, said dispersion point being positioned adjacent the side of the passage of said upper section toward which said intermediate section is angularly directed.

15. A single dispersion point fuel-air mixing apparatus for an internal combustion engine having an intake manifold, comprising (a) air stream control means for forming an airstream and for controlling the amount of air admitted to the intake manifold of the internal combustion engine;

(b) fuel injection means for injecting liquid fuel toward a single dispersion point within the airstream formed by said airstream control means at which point fuel particles are formed and segregated within one portion of the airstream under certain airstream conditions;

(c) airstream directing means for changing the direction of movement of the airstream to cause the fuel particles to be more evenly dispersed throughout a cross section of the airstream as it passes through the intake manifold due to the greater inertia of the fuel particle as compared with air.

16. Apparatus as defined in claim 15, wherein said airstream directing means includes a first portion containing a first airstream passageway downstream from the fuel dispersion point and arranged to allow the airstream to pass therethrough when carrying the segregated fuel particles within a portion of the airstream offset from the longitudinal axis of said first passageway and a second portion containing a second airstream passageway downstream from said first airstream passageway, the longitudinal axis of said second airstream passageway being arranged with respect to the longitudinal axis of said first airstream passageway to cause the inertia of the fuel particles to more thoroughly mix the fuel particles with the airstream as the airstream moves from said first portion to said second portion.

17. A method for mixing fuel and air for an internal combustion engine having an intake manifold, comprising the steps of:

(a) forming an airstream for introduction into the intake manifold;

(b) controlling the amount of air reaching the intake manifold by adjusting the size and velocity of the airstream;

(c) injecting fuel toward a single dispersion point within the airstream formed in step (a) at which point fuel particles are formed and segregated whereby the fuel particles tend to be concentrated within one portion of the airstream under certain airstream conditions; and (d) redirecting the path of movement of the airstream to cause the fuel particles to be more evenly dispersed throughout a cross-section of the airstream as it passes through the intake manifold due to the greater inertia of the fuel particles as compared with air.

* * * * *.